US007278897B2

(12) United States Patent
Hirano

(10) Patent No.: US 7,278,897 B2
(45) Date of Patent: Oct. 9, 2007

(54) METHOD OF MANUFACTURING DISPLAY DEVICE HAVING COLUMNAR SPACERS

(75) Inventor: Shinji Hirano, Mihama-ku (JP)

(73) Assignee: Kawasaki Microelectronics, Inc., Chiba (JP)

( * ) Notice: Subject to any disclaimer, the term of this patent is extended or adjusted under 35 U.S.C. 154(b) by 732 days.

(21) Appl. No.: 10/759,012

(22) Filed: Jan. 20, 2004

(65) Prior Publication Data

US 2004/0147199 A1 Jul. 29, 2004

(30) Foreign Application Priority Data

Jan. 23, 2003 (JP) ..... 2003-014527

(51) Int. Cl.
*H01J 9/26* (2006.01)
*H01J 9/00* (2006.01)

(52) U.S. Cl. ..... 445/66; 445/23

(58) Field of Classification Search ..... 445/23–25, 445/66, 33; 313/238, 292
See application file for complete search history.

(56) References Cited

U.S. PATENT DOCUMENTS 5,205,770 A * 4/1993 Lowrey et al. ..... 445/24
5,336,585 A * 8/1994 Takahashi et al. ..... 430/284.1
5,526,151 A 6/1996 Miyazaki et al.
5,739,890 A 4/1998 Uda et al.
5,916,004 A 6/1999 Farnworth
6,465,268 B2 10/2002 Hirakata et al.

FOREIGN PATENT DOCUMENTS

JP 5-345435 12/1993
JP 9-252003 9/1997
JP 10-104636 4/1998

* cited by examiner

*Primary Examiner*—Joseph Williams
(74) *Attorney, Agent, or Firm*—Oliff & Berridge PLC

(57) ABSTRACT

A method of manufacturing a display device capable of maintaining a cell gap constant is provided. The method includes forming a plurality of columnar spacers on a substrate on which a plurality of pixel electrodes are formed; forming a coating material film with a flat upper surface on the substrate so that heads of the columnar spacers protrude from the flat upper surface of the film of the coating material; and polishing the protruded heads of the columnar spacers using the flat upper surface of the coating material as a reference surface until the top faces of the columnar spacers are flush with the flat upper surface of the film of the coating material.

9 Claims, 8 Drawing Sheets

METHOD OF MANUFACTURING DISPLAY DEVICE HAVING COLUMNAR SPACERS

BACKGROUND OF THE INVENTION

1. Field of Invention

This invention relates to a method of manufacturing a display device using an electro-optic substance such as liquid crystal. In particular, it relates to a method of manufacturing an active matrix substrate having driver elements and pixel electrodes arrayed in a matrix.

2. Description of Related Art

In a display device using an electro-optic substance such as a liquid crystal, the electro-optic substance is generally enclosed in a gap between two substrates. On one of the substrates, electrodes corresponding to pixels (pixel electrodes) are arrayed in a matrix form. By applying a voltage to the pixel electrodes, optical characteristics of the electro-optic substance located in the region corresponding to each of the pixels are changed so as to display an image.

An active matrix display is especially provided with an active matrix substrate such that a driver element such as, for instance, a transistor, is arranged along with the pixel electrodes for applying a predetermined voltage to the pixel electrode.

There are two types of display devices: a transmission-type display device and a reflection-type display device. The transmission-type display device has a transparent substrate, such as a glass plate, on which a thin semiconductor layer is formed so as to form a thin film transistors (TFT) as the driver element. The pixel electrode may also be formed of a transparent material.

On the other hand, the reflection-type display device may have an opaque substrate. For example, a reflection-type display device is formed on a semiconductor substrate (a silicon wafer). Driver elements, such as transistors, are formed on the surface of the substrate itself or on a thin semiconductor layer formed on the surface of the substrate. A pixel electrode is formed of an opaque material with a high reflectivity such as, for instance, an aluminum film.

An example of the active matrix substrate used in the transmission-type display device is shown in a plan view of FIG. 11. The active matrix substrate shown in FIG. 11 includes a pixel region 102 having several tens to several millions of pixels formed thereon in a matrix arrangement, a black matrix (light shield region) 104, and a wiring region 106. Each portion of the pixel region 102 shielded by the black matrix is provided with a TFT for switching an electric charge entering and leaving each pixel electrode.

FIG. 12 is a schematic sectional view showing a principal structure of an active matrix liquid crystal display device using the active matrix substrate shown in FIG. 11.

The liquid crystal display device shown in FIG. 12 includes a transparent substrate 110 shown at the bottom of the drawing, and a TFT active layer (thin semiconductor layer) 112 formed on the surface of the substrate 110. A gate electrode 114, a data line 116, a drain electrode 118, an interlayer dielectric layer 120, and a black matrix (light shield region) 104, are formed above the TFT active layer 112. On the interlayer dielectric layer 120, a pixel electrode 122*a* made of a film of, for instance, transparent conductive material such as ITO (indium tin oxide) and an alignment film 124*a* formed of, for example, polyimide are formed.

The stack of layers in the lower part of the display device, from the substrate 110 to the alignment film 124*a*, makes up the active matrix substrate 130. On the other hand, as shown in the upper part of the drawing, on a transparent substrate (upper substrate) 128, an electrode 122*b* made of a transparent conductive film and an alignment film 124*b* are formed so as to constitute an opposing substrate 132.

The active matrix substrate 130 and the opposing substrate 132 are held together so as to oppose each other, forming a space (cell gap) G therebetween. Liquid crystal 126 is injected into the cell gap G.

An even cell gap G is preferable, because uneven cell gap between the substrates causes unevenness in the brightness and color of the display. In practice, however, it is difficult to realize a high degree of accuracy of the cell gap G over the entire surface of the display device.

One of the reasons is that the active matrix substrate 130 and the opposing substrate 132 are not completely flat. In the active matrix substrate 130 in particular, various films are deposited with various degrees of stress and are thermally treated at various temperatures. Even if the substrate 110 is completely flat, it is difficult to maintain the final active matrix substrate 130 flat.

In order to control the evenness of the cell gap G, a method is known in which particulate spacers (beads) are sprayed on the active matrix substrate. See, for example, Japanese Unexamined Patent Application Publication No. A-10-104636.

Also, a technique is proposed to provide cell gap holding members (columnar spacers) by patterning a film of resin or inorganic material on the active matrix substrate. For example, Japanese Unexamined Patent Application Publication No. A-10-339889 proposes a method to form gap holding members by patterning a photosensitive polyimide film planarized by spin coating and standing at room temperature and further planarized by CMP (chemical mechanical polishing). Further, Japanese Unexamined Patent Application Publication No. A-8-248425 proposes a method to form the spacers by patterning a silicon oxide film deposited by plasma CVD (chemical vapor deposition) and planarized by the CMP method.

In the method of spraying particulate spacers, as schematically shown in FIG. 13, however, particulate spacers 134 are arranged at random positions. In other words, the positions of the particulate spacers 134 cannot be controlled. The particulate spacers 134 arranged in the pixel region 102 disturb the orientation of the liquid crystal, causing distortion in the displayed image.

As a countermeasure therefor, Japanese Unexamined Patent Application Publication No. A-10-104636 proposes a method of blowing air to the spacers after they are sprayed so that the spacers remain only in regions other than the pixel region. Even when this measure is employed, however, the particulate spacers move during the process of injecting the liquid crystal into the cell gap. Therefore, it is difficult to completely control the positions of the particulate spacers in practice. Also, the movement of the spacers during liquid crystal injection causes dispersion in the density of spacers on the surface. This dispersion in the density increases the dispersion in the cell gap.

On the other hand, in a method of forming columnar spacers by patterning resin or inorganic material film, the spacer position is controllable. However, resin materials generally have poor thermal and light stability. Shrinkage of the columnar spacers due to thermal cycles causes dispersion in the cell gap. Also, the image quality may be degraded by irradiation with light.

In the case where the columnar spacers are formed with inorganic material, the thermal and light stability can be improved. However, as shown in FIG. 11, the surface on which an inorganic film is deposited by plasma CVD has unevenness due to the presence of the pixel electrodes and the TFTs. The surface of a silicon oxide film deposited on such a substrate is hence not flat due to the unevenness of the surface of the substrate. If such a film is patterned, flat-top columnar spacers with even height cannot be formed, and a constant cell gap cannot be maintained.

Accordingly, Japanese Unexamined Patent Application Publication No. A-8-248425 proposes to planarize the surface of a silicon oxide film by CMP. However, as will be described in detail later, it is difficult to achieve a high flatness by the CMP of the entire surface of the film.

SUMMARY OF THE INVENTION

This invention has been made in view of the above-described problems. It is an object of this invention to provide a method of manufacturing a display device capable of maintaining a constant cell gap.

In order to solve the problem described above, various exemplary embodiments of this invention include a method of manufacturing a display device comprising forming a plurality of columnar spacers having heads on a surface of a substrate, forming a coating material film having a flat upper surface on the surface of the substrate on which the plurality of columnar spacers are formed so that the heads of the columnar spacers protrude from the flat upper surface of the coating material film, and polishing the protruded heads of the columnar spacers using the flat upper surface of the coating material film as a reference, until top faces of the columnar spacers are flush with the flat upper surface of the coating material film.

Moreover, various exemplary embodiments of the methods of this invention include a method of manufacturing a display device comprising forming a plurality of columnar spacers having heads on a surface of a substrate on which a plurality of pixel electrodes are present, forming a coating material film having a flat upper surface on the surface of the substrate on which the plurality of columnar spacers are formed, so that the heads of the columnar spacers protrude from the flat upper surface of the coating material film, and polishing the protruded heads of the columnar spacers using the surface of the coating material film as a reference until top faces of the columnar spacers are flush with the upper surface of the coating material film. Various embodiments of this invention include a method of manufacturing a display device further comprising bonding the matrix substrate having the plurality of columnar spacers with the polished top faces to an opposing substrate such that a gap between the substrates is maintained by the columnar spacers.

According, a manufacturing method of display device capable of maintaining a constant cell gap can be provided.

DETAILED DESCRIPTION OF PREFERRED EMBODIMENTS

This invention was first described in Japanese Patent Application No. 2003-14527, which is incorporated by reference in its entirety.

A preferred embodiment of an exemplary manufacturing method according to this invention will be described below in detail with reference to the attached drawings.

A method of manufacturing a reflection-type electro-optic display device using liquid crystal will be described below as an exemplary embodiment of a method of manufacturing a display device according to this invention. The process steps of the manufacturing method of the display device according to this embodiment are shown in FIGS. 1 to 9.

Figure 1:
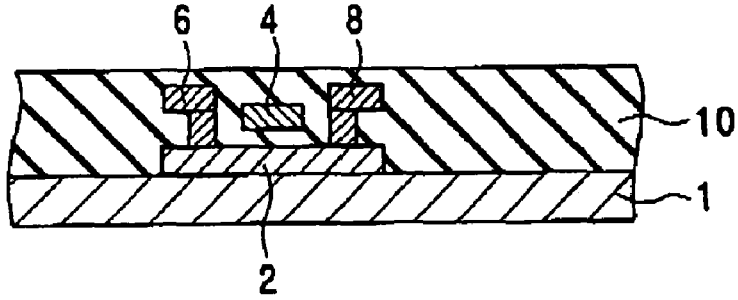
FIG. 1 is an explanatory sectional view illustrating a process step of manufacturing a display device according to an exemplary embodiment showing a state in which a first interlayer dielectric layer is formed.

First, in the process step shown in FIG. 1, on the surface of a silicon (Si) substrate 1, a TFT active layer 2 is formed; a gate electrode 4, a data line 6, and a drain electrode 8 are formed on the TFT active layer 2; and a first interlayer dielectric layer 10 is formed by depositing a boro-phosphor-silicate glass (BPSG) film and a non-doped silicate glass (NSG) film to cover the entire surface of the substrate 1, the gate electrode 4, the data line 6 and the drain electrode 8. The surface of the first interlayer dielectric layer 10 is planarized by polishing it by oxide-film CMP.

Figure 2:
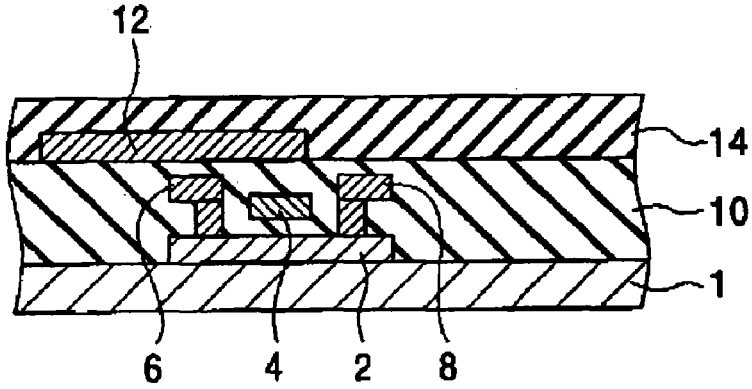
FIG. 2 is an explanatory sectional view illustrating a process step of manufacturing the display device according to the exemplary embodiment showing a state in which a second interlayer dielectric layer is further formed.

Next, in the process step shown in FIG. 2, wirings for peripheral circuits (not shown), a light-shield film (black matrix) 12, and a second interlayer dielectric layer 14 are formed.

Figure 3:
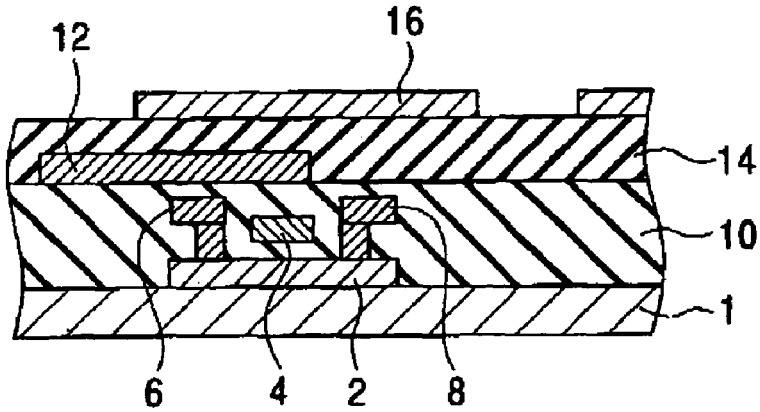
FIG. 3 is an explanatory sectional view illustrating a process step of manufacturing the display device according to the exemplary embodiment showing a state in which a pixel electrode is further formed.

Then, in the process step shown in FIG. 3, on the second interlayer dielectric layer 14, pixel electrodes 16 are formed by sputtering and patterning a film of opaque and highly reflective material such as an Aluminum-based alloy (AlCu, for example) film. The thickness of this film is controlled to be about 100 nm to 200 nm, and the minimum pixel size is patterned to be several tens $\mu m^2$.

Figure 4:
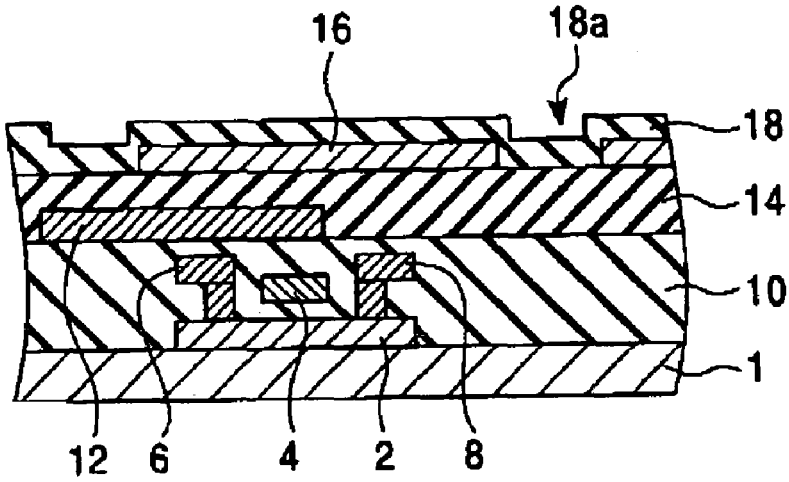
FIG. 4 is an explanatory sectional view illustrating a process step of manufacturing the display device according to the exemplary embodiment showing a state in which a plasma oxide film is formed and the film thickness is adjusted.

Next, in the process step shown in FIG. 4, on the pixel electrodes 16, a silicon oxide film (plasma oxide film) 18 is deposited by plasma CVD (chemical vapor deposition) using a silane-based source gas atmosphere.

Specifically, the film quality of the plasma oxide film 18 is adjusted to have a refractive index of 1.35 to 1.65 (1.50±0.15), and the film 18 has a thickness of 400 nm±100 nm.

Subsequently, the plasma oxide film 18 is coated with an inorganic SOG (spin-on-glass) material, and SOG etching back is performed for planarizing surface areas between pixels. In the SOG etching back process, the remaining thickness of the insulating film (the plasma oxide film 18) on the pixel electrode is adjusted to be about 250 nm±50 nm.

However, especially when the gap between pixels is small, a completely flat surface cannot be obtained even after the SOG etching back process. For example, a quadruple point, i.e., the point surrounded by four adjacent pixels, is difficult to planarize, and it becomes a recess 18*a* as shown in the drawing. The invention addresses this problem as described below.

Figure 5:
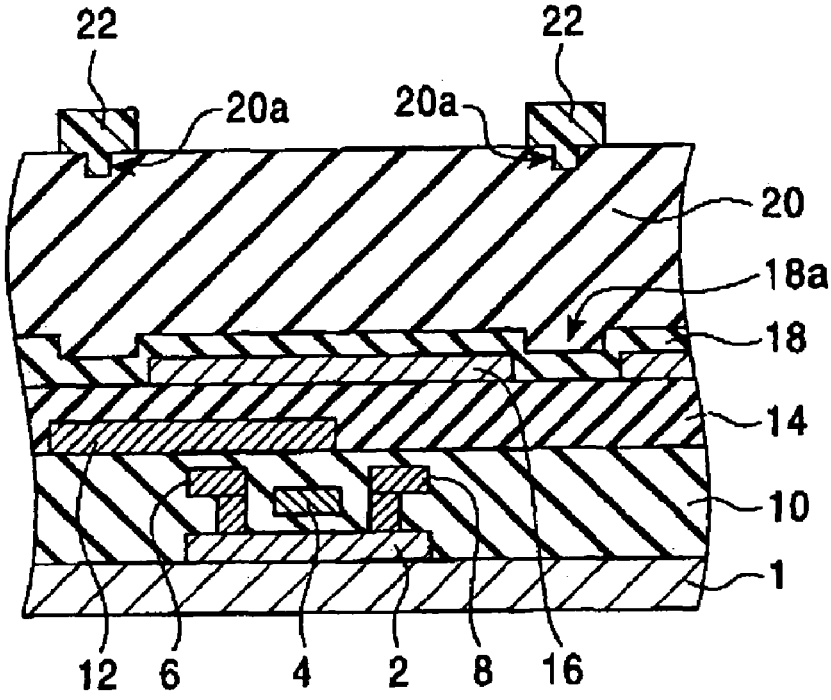
FIG. 5 is an explanatory sectional view illustrating a process step of manufacturing the display device according to the exemplary embodiment showing a state in which a plasma nitride film is further formed.

Next, in the process step shown in FIG. 5, on the plasma oxide film 18 after the SOG etching back process, a silicon nitride film (plasma nitride film) 20 is deposited by plasma CVD. As will be described later, patterning this plasma nitride film 20 forms columnar spacers. The film quality of the plasma nitride film 20 is adjusted to have a refractive index range of from about 1.40 to about 1.80, and the film is made to have a film thickness of from about 1.8 μm to about 2.0 μm.

A parallel-plate plasma CVD apparatus using a source gas atmosphere of, for example, a mixture of $SiH_4$ gas, $N_2O$ gas, $NH_3$ gas, and $N_2$ gas is preferably used to form the plasma nitride film 20.

For optimizing the image quality, the refractive index of the plasma nitride film 20 is adjusted to correspond to the refractive index of a liquid crystal, and to maintain the relationship of the complex refractive index between the plasma nitride film 20 deposited on the pixel and the liquid crystal. This adjustment may be made by adjusting the mixing ratio of $N_2O$ gas and/or by adjusting the plasma discharge power.

For example, for obtaining a plasma nitride film with a refractive index of 1.80, the mixing ratio of $N_2O$ gas is adjusted to be zero. For obtaining a plasma nitride film with a refractive index of 1.40, the $N_2O$ gas is mixed at about twice the flow rate of $NH_3$ gas.

In the case where the mixing ratio of $N_2O$ gas is zero, the deposited film is a silicon nitride film. In the case where the $N_2O$ gas is mixed, an amount of oxygen exceeding the residual oxygen ingredient is added to the forming film, so that the film becomes a silicon oxynitride film. Both the silicon nitride film and the silicon oxynitride film are referred to as a "plasma nitride film" below. These films have excellent thermal and light stability, and can be deposited by commercially available plasma CVD apparatus.

Because the hardness of the plasma nitride film is higher than that of the plasma oxide film, defects such as scratches during the CMP process, can be suppressed. Moreover, by controlling deposition conditions as described above, the refractive index is adjusted so as to optimize the image quality.

On the plasma nitride film 20, a distorted recess 20*a* shown in FIG. 5 is also formed above the recess 18*a* on the surface of the plasma oxide film 18 at the quadruple point mentioned above.

Subsequently, a photoresist film is formed on the plasma nitride film 20 so as to form a resist pattern 22.

Figure 6:
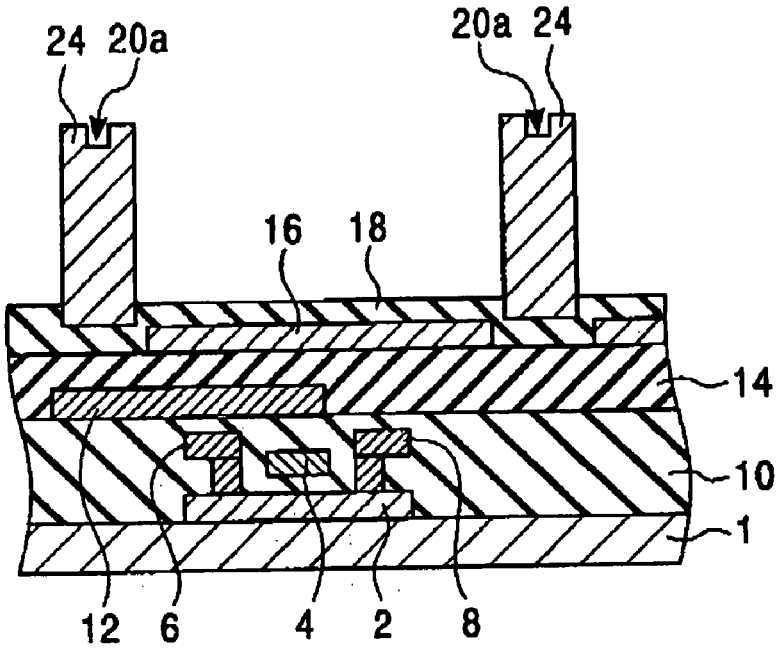
FIG. 6 is an explanatory sectional view illustrating a process step of manufacturing the display device according to the exemplary embodiment showing a state in which columnar spacers are formed.

Next, in the process step shown in FIG. 6, the plasma nitride film 20 and the plasma oxide film 18 on the pixel electrodes are dry-etched using the resist pattern 22 as a mask. Thereby, columnar spacers 24 of plasma nitride are formed.

After the plasma nitride film 20 is selectively etched, the thickness of the plasma oxide film 18 remaining on the pixel electrodes is adjusted to about 50 nm. The thickness may be adjusted by, for example, adjusting the overetching time after detecting the completion of the etching of the plasma nitride film 20 with an optical emission spectroscopy. Then, after the resist pattern 22 is removed, $H_2$ sintering is performed at about 450° C. for about 90 minutes in a hydrogen atmosphere. During this stage, however, the surface of the columnar spacers 24 is not flattened, and the height variation is also large.

The columnar spacers 24 are formed outside the display region, i.e., between pixel electrodes, so as not to degrade the image quality. At this position, in the stage of the deposition by plasma CVD, the distorted recess 20*a* exists on the surface of the plasma nitride film 20 as described above. Therefore, on the tops of the columnar spacers 24 formed in such a manner, the recess 20*a* also remains unchanged.

Even if the recess 20*a* height is neglected, the film thickness varies due to the non-uniformity of the plasma CVD deposition. As a result, heights of the columnar spacers 24 vary. Therefore, in the following steps, the tops of the columnar spacers 24 are flattened in order to render uniform the height of the columnar spacers 24.

Figure 7:
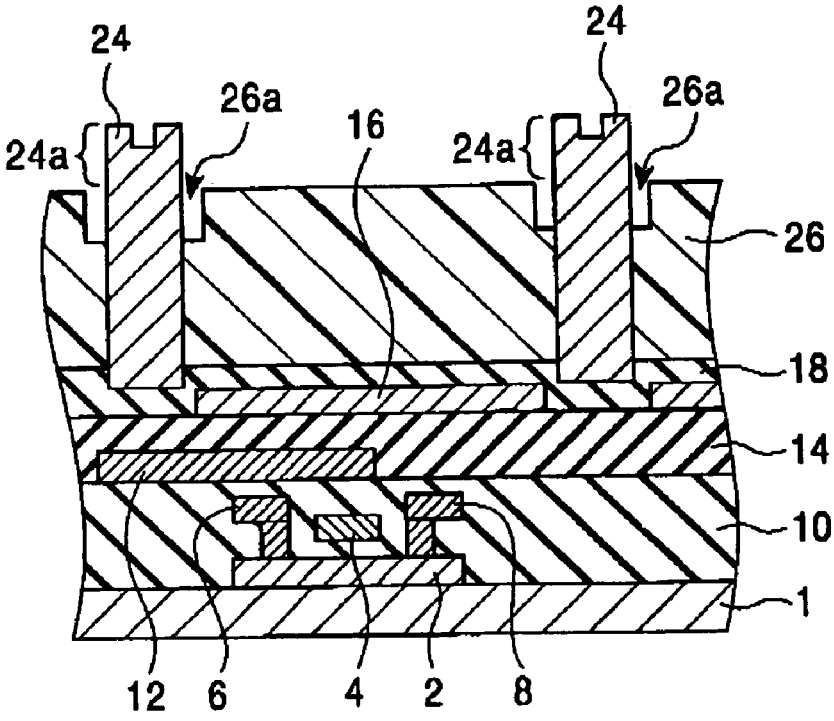
FIG. 7 is an explanatory sectional view illustrating a process step of manufacturing the display device according to the exemplary embodiment showing a state in which a photoresist film is further formed.

Next, in the process step shown in FIG. 7, over the substrate having the columnar spacers 24 of plasma nitride, a photoresist film 26 is formed so as to have a thickness smaller than that of the plasma nitride film 20 (the height of the columnar spacers 24) so that the top portions 24*a* of the columnar spacers 24 protrude from the surface of the photoresist film 26. Also, in the surface of the photoresist film 26, grooves 26*a* are formed within a range of several micrometers from the periphery of the columnar spacers 24.

Specifically, the photoresist film 26 is formed so as to have a thickness smaller by about 400 nm than the height of the columnar spacers 24 by a spin-coating method, for example. Then, the grooves 26*a* are formed by exposing the photoresist film 26 using a photo-mask having openings that expose the columnar spacers 24 and peripheries thereof with margins, and by dissolving the exposed portion of the photoresist film 26 using a developing agent.

An amount of exposure is selected so as to expose only the surface region of the photoresist film 26. Thereby, the grooves 26*a* are formed only on the surface region of the photoresist film 26. That is, the grooves 26*a* are formed shallower than the film thickness of the photoresist film 26. The depth of the grooves 26*a* can be adjusted by the amount of exposure.

Then, thermal curing of the photoresist film is performed.

The grooves 26*a* in the peripheries of the columnar spacers 24 hold slurry in the vicinities of the columnar spacers 24 during the CMP for selectively polishing the protruded heads 24*a* of the columnar spacers 24 during the following step.

Formation of photoresist film by spin coating is a process frequently employed for manufacturing of active matrix substrates or of general semiconductor integrated circuits. The film thickness can be controlled with a high degree of accuracy and uniformity. For example, over the entire surface of the substrate (Si wafer), the film thickness can be controlled within variations of 1%, more specifically in a range of, for example, 1400 nm±14 nm, or 1600 nm±16 nm.

Figure 8:
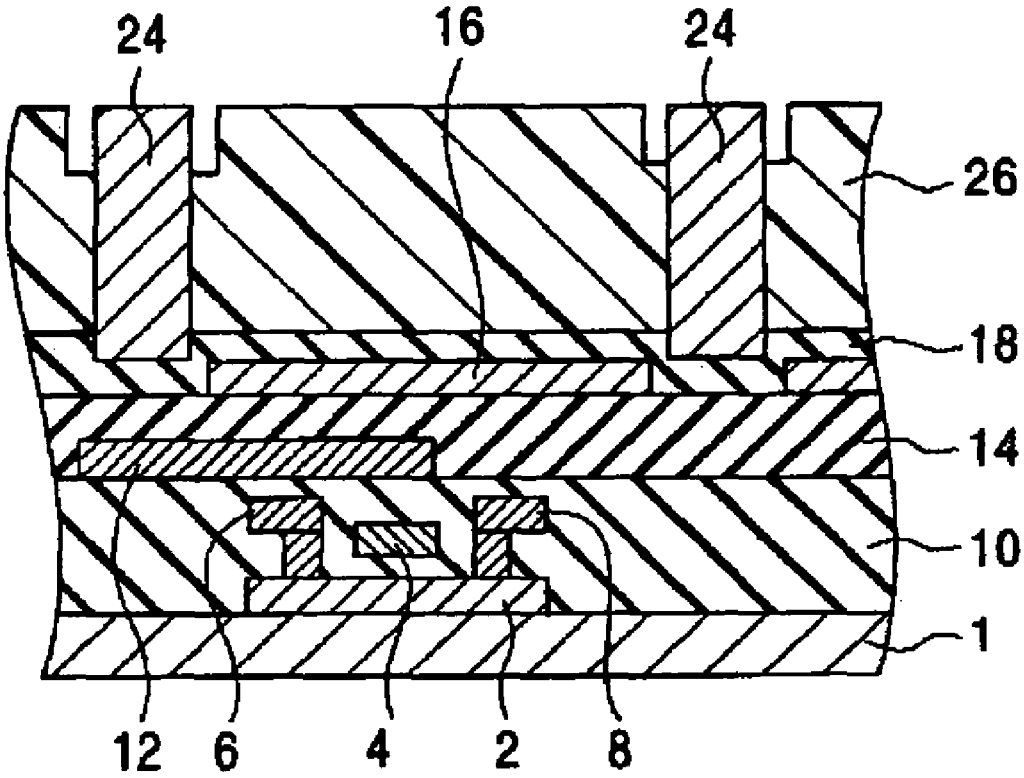
FIG. 8 is an explanatory sectional view illustrating a process step of manufacturing the display device according to the exemplary embodiment showing a state in which heads of the columnar spacers are selectively polished.

Next, in the process step shown in FIG. 8, the protruded heads 24*a* of the columnar spacers 24 are selectively polished by CMP so as to be flush with the surface of the photoresist film 26. At this time, portion of the head 24*a* having the recess 20*a* is removed so as to form the columnar spacer 24 with a flat top.

In the CMP of the heads 24*a* of the columnar spacers 24, commercially available oxide-film CMP slurry material can be utilized.

Thereafter, although not shown in the drawings, the photoresist film 26 is removed so as to finish the forming process of the active matrix substrate.

Then, the active matrix substrate is bonded to an opposing substrate having opposing electrodes and an alignment film formed thereon. A liquid crystal material is enclosed between the substrates by injection. Thereby, the liquid crystal material is held in a cell gap between the active matrix substrate and the opposing substrate. The cell gap is maintained constant by the columnar spacers 24 with uniform height.

The formation method of the columnar spacers 24 will be further described in detail with reference to the drawings.

Figure 9A:
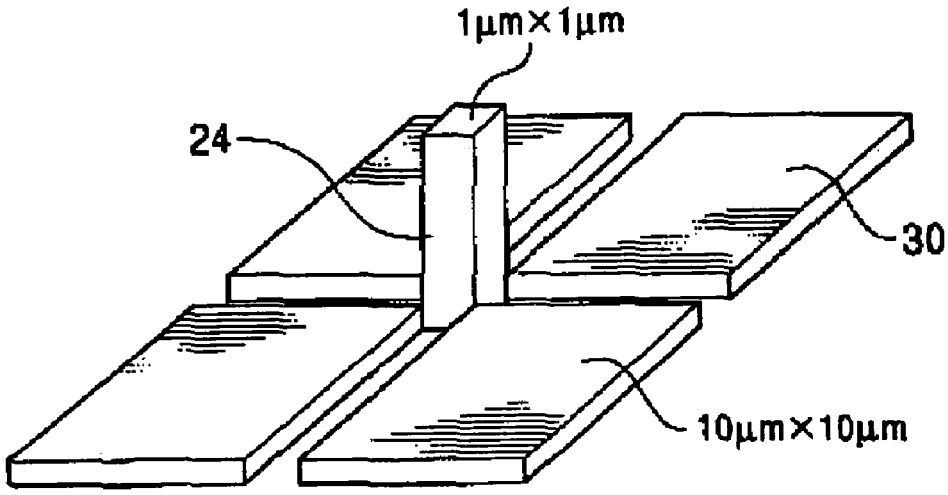
FIG. 9A is a perspective view showing a state in which the columnar spacer is formed.
Figure 9B:
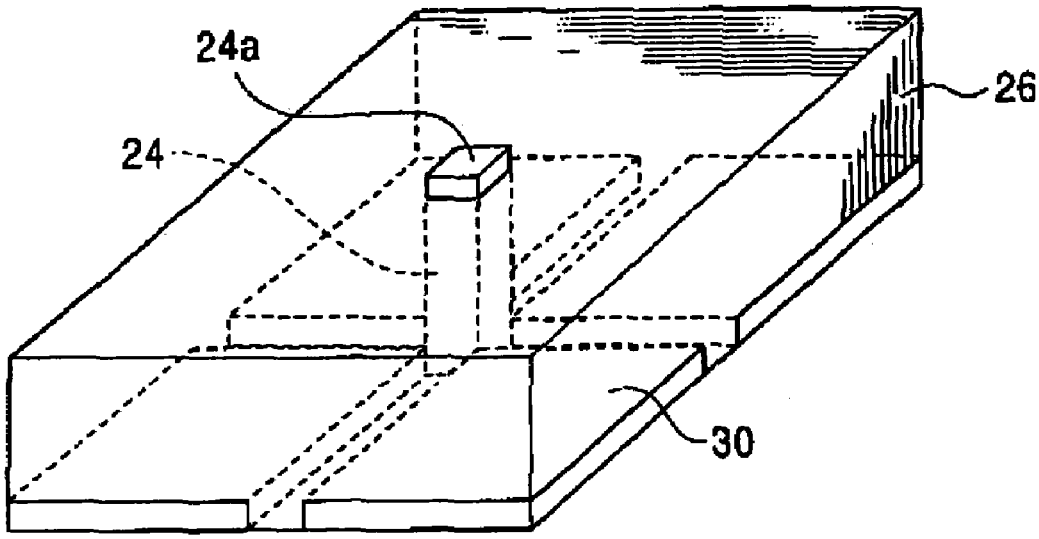
FIG. 9B is a perspective view showing a state in which the photoresist film is formed.

FIG. 9A is a perspective view showing a state in which the columnar spacer 24 is provided between pixel regions 30 (represented by pixel electrodes in the drawing) (see FIG. 6). FIG. 9B is a perspective view showing a state in which the photoresist film 26 is formed thereon (in the state shown in FIG. 9A) so as to protrude the head 24*a* of the columnar spacer 24 therefrom (see FIG. 7).

Figure 10:
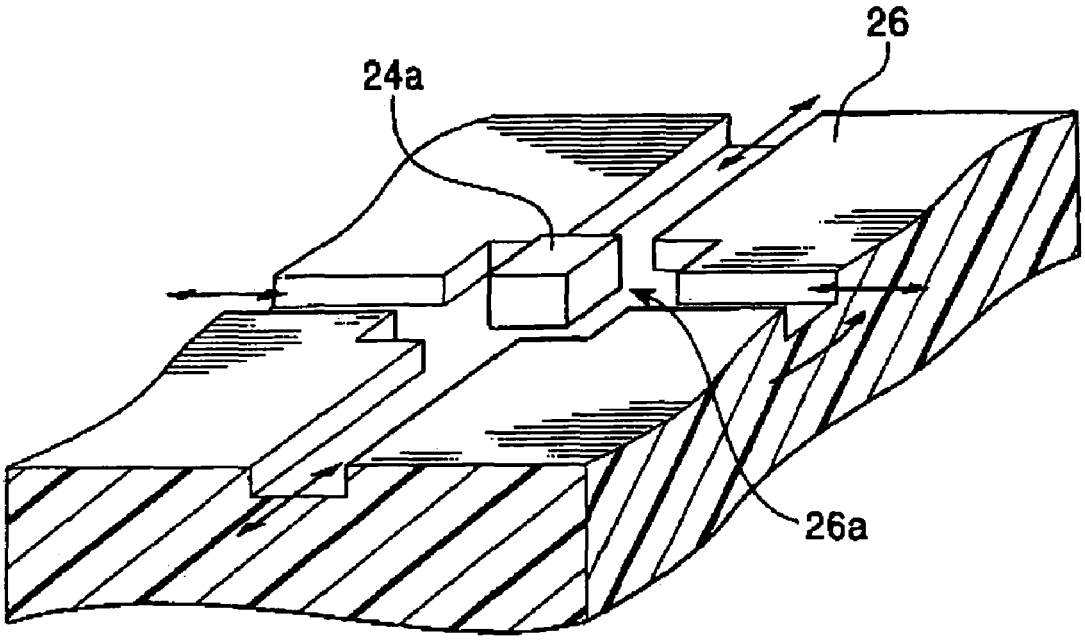
FIG. 10 is a perspective view showing a state in which grooves are formed in the periphery of the columnar spacer.
Figure 11:
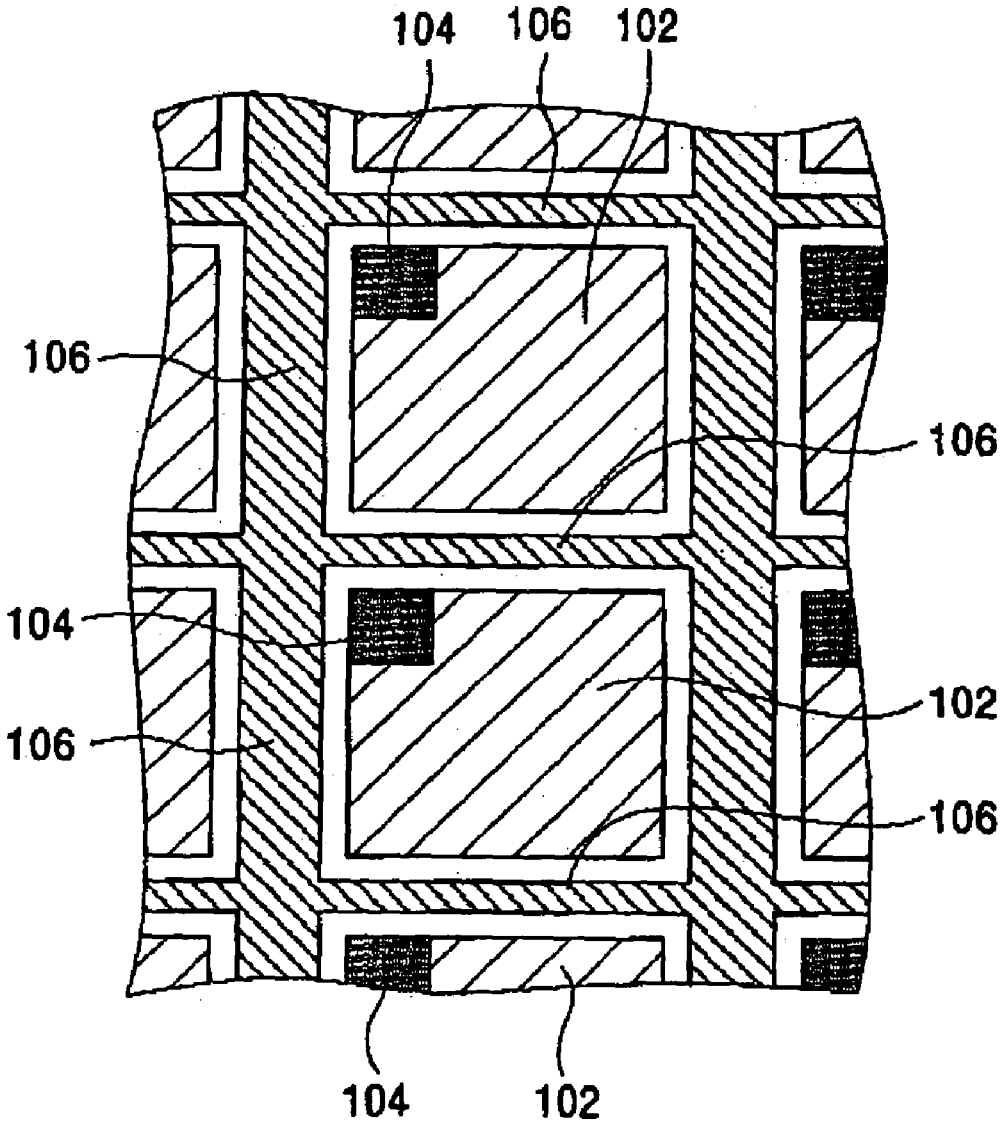
CONVENTIONAL ART FIG. 11
FIG. 11 is a plan view of an example of a transmission-type liquid crystal display.
Figure 12:
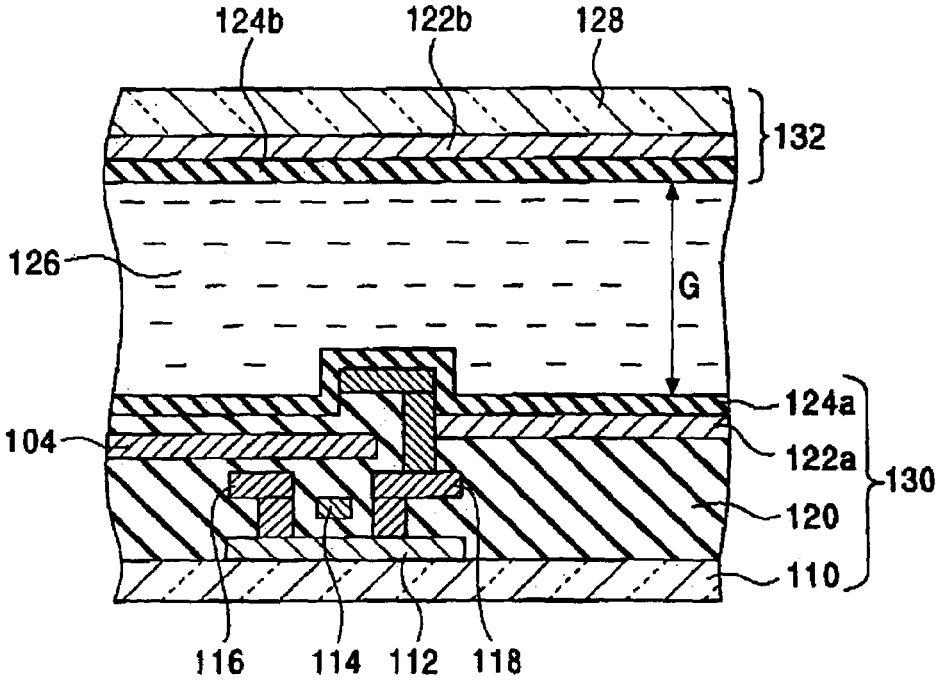
FIG. 12 CONVENTIONAL ART
FIG. 12 is a schematic sectional view showing a principal structure of an active matrix liquid crystal display having a thin film transistor arranged therein.
Figure 13:
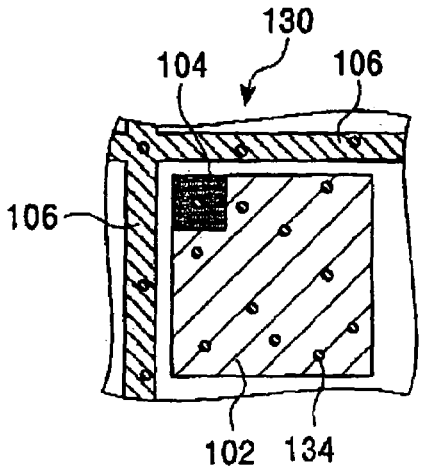
FIG. 13 CONVENTIONAL ART
FIG. 13 is a plan view showing a state in which particulate spacers are sprayed.

In FIGS. 9A to 10, the distorted shape (recess) of the head 24*a* of the columnar spacer 24 is omitted for clarity.

A state in which the grooves 26*a* are formed on the surface of the photoresist film 26 in the periphery of the head 24*a* is shown in FIG. 10 (see FIG. 7). Along the grooves 26*a*, slurry flows in directions shown by arrows in the drawing. At this time, the area of the head 24*a* is much smaller than that of the pixel region 30 covered with the photoresist film 26. For example, while the pixel region 30 is 10 μm×10 μm in size, the columnar spacer 24 may be 1 μm×1 μm, or about 1/100 in area ratio.

The grooves 26*a* provided on the surface of the photoresist film 26 in the periphery of the head 24*a* of the columnar spacer 24 hold the slurry material when the head 24*a* is selectively polished (see FIG. 8). This improves the polishing efficiency.

Although only one columnar spacer 24 is shown in FIG. 10, in practice, a plurality of the columnar spacers 24, are formed, e.g., one at every quadruple point between pixel regions 30. The grooves 26*a* are formed in peripheries of the heads 24*a* of the columnar spacers 24 as well as in regions connecting the heads 24*a* together.

These grooves 26*a* connected together are effective to remove debris produced during CMP, which is the main cause of scratches. Thereby CPM can be performed with little or no damage such as scratches.

By the improvement in polishing efficiency due to the grooves 26*a* in addition to the above-mentioned small area of the head 24*a* as a polishing object, the polishing of the heads 24*a* of the columnar spacers 24 can be completed within a very short period. For example, it can be performed within several ten seconds in spite of the fact that the head is made of plasma nitride film, which is harder than a standard silicon oxide film.

The reduction in polishing time is advantageous for the reduction in manufacturing costs, including the cost of consumables such as slurry and polishing pad. During a polishing time of several ten seconds, the photoresist film 26 is not polished, and it serves as a reference surface for polishing the heads 24*a*.

Exemplary conditions for selective polishing of the head 24*a* of the columnar spacer 24 are as follows: a KOH-based slurry material; main polishing pressure of from about 3 PSI to about 5 PSI; main rotation speed of the polishing plate of from about 25 rpm to about 75 rpm; and main rotation speed of the wafer carrier of from about 20 rpm to about 50 rpm.

The main polishing pressure is adjusted corresponding to the film quality of the plasma nitride film 20. For example, in the case of a relatively soft plasma nitride film with a low refractive index, the main polishing pressure and the main rotation speed are reduced. By contrast, in the case of a relatively hard plasma nitride film with a high refractive index, the main polishing pressure and the main rotation speed are increased.

These polishing conditions, even in the latter case, are within substantially the same range as the conditions in planarization of a standard silicon oxide film (the interlayer insulating film 10, for example), which is far softer than the plasma nitride film. Therefore, in addition to the removal of debris by the grooves 26*a*, damage such as scratches can be effectively reduced or prevented.

According to the embodiment of this invention thus explained, after patterning the plasma nitride film to form the columnar spacers 24, coating forms the photoresist film 26, and the heads 24*a* of the columnar spacers 24 are polished by CMP using the upper surface of the photoresist film 26 as a reference. This process achieves much better results for the following points, in comparison with a process such as disclosed in Japanese Unexamined Patent Application Publication No. A-8-248425, in which the CMP is performed immediately after the deposition, and then the columnar spacers are formed by the patterning:

(1) Using the surface of the photoresist film as the reference enables the columnar spacers 24 to improve top flatness and height uniformity.

In general, a photoresist film formed by coating is better in controllability and uniformity of the film thickness in comparison with a silicon nitride film deposited by CVD. For example, as described above, the non-uniformity can be readily suppressed within a range of 1%.

During deposition by CVD, a distorted surface such as the recess 20*a* may form by the effect of a local shape on the substrate surface such as, for instance, the recess 18*a* on the plasma oxide film 18 (see FIG. 5). On the contrary, a local shape on the surface of the substrate rarely affects a surface formed by coating. Therefore, the photoresist film has excellent flatness and height uniformity in comparison with the surface of a silicon nitride film 20 deposited by plasma CVD.

Because CMP is performed using the upper surface of a photoresist film having excellent flatness and height uniformity as the reference, the flatness of the top of the columnar spacer after polishing is improved, and the uniformity in the tops of the columnar spacers 24 arranged on the entire display device can be improved.

(2) Next, within a short period of the CMP time, excellent flatness can be obtained, resulting in excellent uniformity in height.

As described above, the area of the heads 24*a* of the columnar spacers 24 to be polished by the CMP is about 1/100 of that of the pixel regions 30. Therefore, in comparison with the case where the CMP is performed in a state in which the plasma nitride film 20 exists on the entire surface before patterning, the same polished film thickness can be obtained in an extremely short period of time.

Moreover, while a ratio of the area occupied by the recess 20*a* to the entire surface of the plasma nitride film 20 before patterning is extremely small, the area occupied by the recesses 20*a* in the heads 24*a* of the columnar spacers 24 formed by the patterning is large. Accordingly, CMP, after the patterning of the columnar spacer 24, can eliminate the recesses using a much smaller polishing thickness so as to obtain a flat top (the top surface of the columnar spacer 24).

By these two factors, polishing time can be markedly reduced in the case in which the CMP is performed after patterning the columnar spacers, in comparison with the case in which the CMP is performed before the patterning.

Furthermore, polishing the heads 24*a* after patterning the plasma nitride film 20 solves another problem associated with the CMP of a hard film.

That is, especially when a film with a high hardness such as a plasma nitride film is polished by CMP, with increasing polishing time, the non-uniformity of the polishing thickness increases. Therefore, upon performing CMP before the patterning, not only a long polishing time for eliminating the recess 20*a* is required, but also the thickness variation increases in comparison with before the polishing (immediately after the deposition by plasma CVD).

In the case where only the heads 24*a* are polished after the columnar spacers 24 are formed, not only the productivity is improved by reducing polishing time, but also the uniformity in the height of the columnar spacer can be improved by preventing such non-uniformity.

By the advantages of the above items of (1) and (2), columnar spacers 24 with excellent top-surface flatness and height uniformity can be obtained with high productivity. Then, utilizing the columnar spacers 24, a display device with high image quality can be obtained by maintaining the cell gap constant.

If the CMP is performed after the columnar spacers 24 are formed without forming the photoresist film 26, problems such as peeling off of the columnar spacers 24 arise. However, by performing CMP after the photoresist film 26 is formed and cured, the mechanical strength is maintained so as not to have such a peeling off problem. However, if the CMP is performed without forming the grooves 26*a*, the peeling off problems due to increased frictions, may occur because of insufficient flowing and holding of the slurry material to the peripheries of the heads 24*a* of the columnar spacers 24.

As described above in detail, with the method of manufacturing display device according to this embodiment, an active matrix substrate having the columnar spacers 24 with excellent top-surface flatness and height uniformity can be obtained. Utilizing these columnar spacers 24, a display device with high image quality can be obtained by maintaining the cell gap constant. Moreover, such columnar spacers 24 can be formed with improved productivity within a short polishing time.

In particular, when the columnar spacers 24 are formed of plasma nitride, in addition to having high thermal and light stability, the refractive index of the columnar spacers 24 is appropriately adjusted so as to improve the image quality.

As the manufacturing method of the display device according to this invention has been described in detail, this invention is not limited to the embodiment described above. Various modifications and improvements can be made within the scope of this invention.

According to the embodiment, a material used to make columnar spacers include silicon nitride or silicon oxynitride formed by plasma CVD. Alternatively, various materials may be used as long as the materials have enough strength to withstand the pressure during bonding to the opposing substrate while maintaining the cell gap constant. However, it is generally preferable to form the columnar spacer with an inorganic material in view of thermal and light stability, and mechanical strength.

According to the embodiment, a photoresist is used for obtaining a reference surface in polishing the head 24*a* of the columnar spacer 24. Alternatively, as long as a coating material has the required uniformity in film thickness and surface flatness, various materials may be used. However, generally applicable materials may include organic materials. In order to serve as a reference without being substantially polished during polishing of the head of the columnar spacer which is made of silicon nitride or silicon oxynitride, it is also preferable to utilize organic coating materials.

According to the embodiment, the grooves 26*a* are formed in the peripheries of the heads 24*a* of the columnar spacers 24 by exposing the surface of the photoresist film, which is photosensitive, to light. The photosensitive material enables the grooves 26*a* to be readily formed.

However, even when a material without photosensitivity is used, after a coating material film is formed for use as a reference surface during polishing, a thin photoresist film is further formed so as to pattern the film by exposure. Then, etching the film using the formed photoresist pattern as a mask can form the grooves 26*a*.

What is claimed is:

1. A method of manufacturing a display devices comprising:

forming a plurality of columnar spacers, having heads, on a surface of a substrate;

subsequently forming a coating material film, having a flat upper surface, on the surface of the substrate on which the plurality of columnar spacers are formed so that the heads of the columnar spacers protrude above the flat upper surface of the coating material film but do not extend over the coating material film; and subsequently polishing the protruded heads of the columnar spacers using the flat upper surface of the coating material film as a reference, until top faces of the columnar spacers are flush with the flat upper surface of the coating material film.

2. The method according to claim 1, wherein the plurality of columnar spacers are formed on the surface of the substrate on which a plurality of pixel electrodes are present.

3. The method according to claim 2, wherein the forming the plurality of columnar spacers includes forming the columnar spacers at quadruple points between pixel electrodes.

4. The method according to claim 1, wherein the forming the coating material film includes forming grooves, which are shallower than the thickness of the coating material film, at peripheries of the heads of the plurality of the columnar spacers and in regions connecting the peripheries together.

5. The method according to claim 4, wherein the polishing the protruded heads of the columnar spacers includes chemical mechanical polishing.

6. The method according to claim 4, wherein the coating material is photosensitive, and the grooves are formed by selectively exposing the surface of the coating material film to light.

7. The method according to claim 1, wherein the columnar spacers are made of inorganic insulating material, and the coating material is an organic material.

8. The method according to claim 1, wherein the columnar spacers are made of one of silicon nitride and silicon oxynitride.

9. A method of manufacturing a display device, comprising:

preparing a matrix substrate, the preparing the matrix comprising:

forming a plurality of columnar spacers, having heads, on a surface of a substrate on which a plurality of pixel electrodes are present;

subsequently forming a coating material film, having a flat upper surface, on the surface of the substrate on which the plurality of columnar spacers are formed, so that the heads of the columnar spacers protrude above the flat upper surface of the coating material film but do not extend over the coating material film; and subsequently polishing the protruded heads of the columnar spacers using the surface of the coating material film as a reference until the top faces of the columnar spacers are flush with the flat upper surface of the coating material film; and bonding the matrix substrate having the plurality of columnar spacers with the polished top faces to an opposing substrate such that a gap between the substrates is maintained by the columnar spacers.

* * * * *